US006638898B2

(12) United States Patent
Swami et al.

(10) Patent No.: US 6,638,898 B2
(45) Date of Patent: Oct. 28, 2003

(54) PROCESS OF PREPARING MULTI-FUNCTIONAL AMINO DI(ALKYLCYCLOHEXYL) PHOSPHORDITHIOATE ADDITIVE FOR LUBRICANT COMPOSITION FROM SATURATED CASHEW NUT SHELL LIQUID

(75) Inventors: Krishan Kumar Swami, Maharastra (IN); Shanti Parkash, Maharastra (IN); Rakesh Sarin, Maharastra (IN); Deepak Kumar Tuli, Maharastra (IN); Akhilesh Kumar Bhatnagar, Maharastra (IN)

(73) Assignee: Indian Oil Corporation Limited, Maharastra (IN)

( * ) Notice: Subject to any disclaimer, the term of this patent is extended or adjusted under 35 U.S.C. 154(b) by 202 days.

(21) Appl. No.: 09/823,688

(22) Filed: Mar. 30, 2001

(65) Prior Publication Data

US 2002/0128159 A1 Sep. 12, 2002

(30) Foreign Application Priority Data

Jan. 8, 2001 (IN) ..... 19/MUM/2001

(51) Int. Cl.[7] ..... C10M 137/08

(52) U.S. Cl. ..... 508/436; 508/112; 508/353; 508/429

(58) Field of Search ..... 508/436, 112, 508/353, 429

(56) References Cited

U.S. PATENT DOCUMENTS 4,328,113 A 5/1982 Horodysky et al.
4,395,498 A 7/1983 Benham
4,478,732 A 10/1984 Horodysky et al.
4,505,830 A 3/1985 Vinci
4,618,437 A 10/1986 Horodysky
5,218,038 A 6/1993 Johnson et al.
5,433,774 A 7/1995 Kapl et al.
5,910,468 A * 6/1999 Dohhen et al.
5,916,850 A 6/1999 Tuli et al.
6,255,439 B1 * 7/2001 Avadhani et al.
6,339,052 B1 * 1/2002 Dohhen et al.

* cited by examiner

*Primary Examiner*—Jerry D. Johnson
(74) *Attorney, Agent, or Firm*—Sidley Austin Brown & Wood LLP

(57) ABSTRACT

A process for the preparation of multi-functional additive, amino di(alkylcyclohexyl) phosphorodithioate, for use as an additive in a lubricant composition so as to impart improved coefficient of friction, wear reduction, antioxidant and extreme pressure properties, including the steps of (a) hydrogenating distilled technical cashew nut shell liquid with palladium or nickel or platinum catalyst; to fully hydrogenate the olefinic chain and aromatic ring of the precursor; (b) reacting fully hydrogenated technical cashew nut shell liquid with phosphorus pentasulfide to obtain unpolymerized hydrogenated cashew nut shell liquid phosphorodithioic acid, the reaction being carried out at a temperature ranging from 20 to 140° C. ; and (c) condensing the unpolymerized fully saturated cashew nut shell liquid phosphorodithioic acid with at least one amine to obtain the amino di(alkylcyclohexyl) phosphorodithioate. A lubricant containing a major proportion of a material selected from the group consisting of an oil of lubricating viscosity and a grease; and remainder an additive including amino di(alkylcyclohexyl)phosphorodithioate prepared by the foregoing process.

19 Claims, No Drawings

PROCESS OF PREPARING MULTI-FUNCTIONAL AMINO DI (ALKYLCYCLOHEXYL) PHOSPHORDITHIOATE ADDITIVE FOR LUBRICANT COMPOSITION FROM SATURATED CASHEW NUT SHELL LIQUID

This invention relates a process for preparing multi-functional additive for lubricant composition from saturated cashew nut shell liquid. The said additive for use in a lubricant, imparts suitable properties of friction reducing, antioxidant, antiwear and extreme pressure additives.

BACKGROUND

Cashew nut shell liquid (CNSL) occurs as a reddish brown viscous liquid in the soft honeycomb structure of the shell of cashewnut, a plantation product obtained from the cashew tree, Anacardium Occidentale L. Native to Brazil, the tree grows in the coastal areas of Asia & Africa. Cashewnut attached to cashew apple is grey colored, kidney shaped and 2.5–4 cm long. The shell is about 0.3 cm thick, having a soft leathery outer skin and a thin hard inner skin. Between these skins is the honeycomb structure containing the phenolic material popularly called CNSL. Inside the shell is the kernel wrapped in a thin brown skin, known as the testa.

The nut thus consists of the kernel (20–25%), the shell liquid (20–25%) and the testa (2%), the rest being the shell. CNSL, extracted with low boiling petroleum ether, contains about 90% anacardic acid and about 10% cardol. CNSL, on distillation, gives the pale yellow phenolic derivatives, which are a mixture of biodegradable unsaturated m-alkylphenols, including cardanol. Catalytic hydrogenation of these phenols gives a white waxy material, predominantly rich in tetrahydroanacardol.

CNSL and its derivatives have been known for producing high temperature phenolic resins and friction elements, as exemplified in U.S. Pat. Nos. 4,395,498 and 5,218,038. Friction lining production from CNSL is also reported in U.S. Pat. No. 5,433,774. Likewise, it is also known to form different types of friction materials, mainly for use in brake lining system of automobiles and coating resins from CNSL.

Friction is also a problem any time two surfaces are in sliding or rubbing contact. It is of special significance in an internal combustion engine and related power train components, because loss of a substantial amount of the theoretical mileage from a gallon of fuel is traceable directly to friction.

It is also known that sliding or rubbing metal or other solid surfaces are subject to wear under conditions of extreme pressure. Wear is particularly acute in modern engines in which high temperatures and contact pressures are prevalent. Under such conditions, severe erosion of metal surfaces can take place even with present generation lubricants unless a load carrying or antiwear additive is present therein. These load carrying, friction reducing, antiwear and antioxidant additives are generally organic compounds, having polar groups, which are capable of forming a film at the mating metal surfaces.

Considerable work has been reported with lubricating oils, mineral and synthetic, to enhance their antioxidant, antiwear and friction reducing properties, by modifying them with suitable additives. The use of lubricant additives containing phosphorus and sulfur has been well documented and widely implemented commercially. These include acid phosphates, thiophosphates, phosphites, phosphate ester, metal dithiophosphates, metal dithiocarbamates, xanthates, phosphonates and the like. Amine compositions have also found wide use as friction reducing additives as exemplified by U.S. Pat. No. 4,328,113 which relates to alkyl amines and diamines and borated adducts of alkylamine and diamines. U.S. Pat. No. 4,478,732 describes imidazoline salts of acid phosphates, while U.S. Pat. No. 4,505,830 is drawn to $C_{10}$–$C_{20}$ alkyl substituted imidazoline salts of boric acid or phosphoric acid as useful in metal working lubricants. U.S. Pat. No. 4,618,437 describes boronated internal imidazoline acid phosphates as effective friction reducers.

The present invention relates to lubricant compositions and more particularly, to lubricant compositions comprising oils of lubricating viscosity or greases thereof containing a minor friction reducing, antiwear and antioxidant additive of hydrocarbyl amine salt of di(alkylcyclohexyl) phosphorodithioic acid derived from cashew nut shell liquid.

Recently, our U.S. Pat. No. 5,916,850 described development of multifunctional additives from cashew nut shell liquid or from saturated alkylphenols derived from cashew nut shell liquid. The patent relates to a process for preparing di (alkylaryl)phosphorodithioate. The products of this invention were found to have antifriction, extreme pressure and antiwear properties.

The object of the present invention is to provide for a multifunctional lubricant/fuel additives, derived from CNSL, a renewable and biodegradable product from vegetable sources and often available at very low price, would amount to substantial overall reduction in the cost of quality, energy efficient lubricant/fuel formulations.

Another object of the present invention is to provide for a lubricant composition and more particularly, to lubricant compositions comprising oils of lubricating viscosity or greases thereof containing a minor friction reducing, antiwear and antioxidant additive of hydrocarbyl amine salt of di(alkylcyclohexyl)phosphorodithioic acid derived from cashew nut shell liquid.

SUMMARY OF THE INVENTION

To achieve the said object the present invention provides a process for the preparation of multi-functional additive, amino di(alkylcyclohexyl) phosphorodithioate, for use as an additive in a lubricant composition comprising the steps of hydrogenating distilled technical cashew nut shell liquid (CNSL) with a catalyst as herein described to fully hydrogenate the olefinic chain and aromatic ring of the precursor and obtain fully saturated CNSL; reacting said fully saturated cashew nut shell liquid with phosphorus pentasulfide to obtain corresponding unpolymerized cashew nut shell liquid phosphorodithioic acid, the reaction being carried out at a temperature ranging from 20 to 140° C.; and condensing the unpolymerized cashew nut shell liquid phosphorodithioic acid with at least one amine to obtain the amino di(alkylcyclohexyl) phosphorodithioate.

The said catalyst is palladium, platinum or nickel.

At least one amine is selected from the group consisting of primary, secondary and tertiary alkyl/alkylaryl amines having an all chain ranging from $C_1$ to $C_{20}$. At least one amine is a mixture of amines selected from the group consisting of primary, secondary and tertiary alkyl and alkylaryl amines and alkylaryl amines having an alkyl chain ranging from $C_1$ to $C_{20}$.

Preferred secondary amines includes dipentylamine, dihexylamine, dicyclohexylanine, bis(2-ethylhexyl)amine, dioctylamine, dinonylamine, didodecylamine.

Preferred primary amines includes oleyl amine, stearyl amine, isostearyl amine, cocoamine, tallow amine, hydrogenated tallow amine, t-alkylamines, diethanolamine, dodecylamine, decylamine, octylamine, 2-ethylhexylamine and butylamine.

Preferred tertiary amines includes triethylamine, tributylamine, triethanol amine. Suitable diamines include diethylenetriamine, triethylenetetramine, N-coco-1,3-propylenediamine, N-oleyl-1.3-propylene diamine.

Generally amines having at least 2 to 4 and up to 24 to 26 carbon atoms including mixtures of such amines have been found to be highly useful in this invention.

The reacting and the condensation steps are carried out in the presence of a solvent.

At least one amine and the phosphorodithioic acid are present in stoichiometric ratios of acid to amine ranging from about 3:1 to about 1:3, preferably from 2:1 to 1:2.

The present invention further includes a lubricant composition comprising a major proportion of a material selected from the group consisting of an oil of lubricating viscosity and a grease and remainder an additive comprising amino di(alkylcyclohexyl)phosphorodithioate which is a condensation product of unpolymerized cashew nut shell liquid phosphorodithioic acid with at least one amine.

The additive is present in an amount ranging from about 0.1 to about 10 wt %, preferably 0.5 to 5 wt %.

The oil of lubricating viscosity is selected from the group consisting of a mineral oil, a synthetic oil, and mixtures thereof.

The said synthetic oils includes polypropylene glycol, trimethylol propane esters, neopentyl and pentaerythritol esters, polyethylene glycol, di(2-ethylhexyl) adipate, fluorocarbons, siloxanes, phenoxy phenyl ethers and poly alphaolefins.

The lubricant composition may include other additives such as polyalkyl succinimide and polyalkenyl ester dispersants, metallic (calcium or magnesium) sulfonates or phenates, metallic phosphorodithioates, polymeric viscosity index improvers The said material is a grease selected from the group consisting of a lithium grease, a calcium grease, a sodium grease, a clay, and a titanium grease.

This invention is more particularly directed to lubricant compositions containing minor additive concentrations of primary, secondary or tertiary amine adducts of di(alkylcyclohexyl)phosphorodithioic acids, derived from fully saturated distilled cashew nut shell liquid, and a major amount of oil of proper lubricating viscosity, which exhibit excellent antiwear, extreme pressure, antifriction and antioxidant properties. Concentrations as little as 1% in fully formulated synthetic and mineral oil based formulations reduce the coefficient of friction by approximately 50% and thus improve lubricity. Synergistic wear reduction is seen to the extent of 50–75%, due to the modest phosphorus content of the highly surface active additive. Antioxidant properties are seen as expected, to the level of 20–50%. The increase in extreme pressure properties of 50–70% over the base fluid are also obtained.

All the reactants used in the process in accordance with this invention can be obtained commercially or made by any convenient means known to the art.

Generally speaking, the process of manufacturing the additives in accordance with this invention may be carried out as follows:

Specifically, cashew nut shell liquid is distilled at reduced pressure to yield a mixture of biodegradable olefinic phenols. The components of CNSL contain a phenolic hydroxyl group and an $C_{15}H_{31-n}$ unsaturated side chain, where n=0, 2,4 or 6. Such a mixture is converted to their saturated $C_{15}$ cyclohexanol derivatives by catalytic reduction in the presence of a platinum, palladium or nickel hydrogenation catalyst. The saturated cyclohexanol is converted to corresponding phosphorodithioic acids by reaction with phosphorus pentasulfide and the phosphorodithioic acids are then converted to form the amine salts thereof by reacting with suitable hydrocarbyl amines, diamines or triamines or mixtures thereof Solvents can optionally be used in either step of the reaction. A wide temperature range can be used to perform either reaction from as low as room temperature to as high as 140.degree. C. or more, with 40–80.degree. C., often preferred. Preferably, the amine and the phosphorodithioic acid are reacted in stoichiometric ratios of acid to amine of from about 3:1 to about 1:3, preferably from 2:1 to 1:2. An excess of amine can be used in this step or a small amount of free acidity can be left by undercharging the amine or the mixtures of amines.

The lubricants contemplated for use herein include both mineral and synthetic hydrocarbon oils of lubricating viscosity, mixtures of mineral and synthetic oils and greases prepared therefrom.

The following examples illustrate the invention, but without intending to imply any limitation thereon.

EXAMPLE 1

Hydrogenation of Distilled Technical Cashew Nut Shell Liquid (CNSL)

Distilled technical CNSL was charged to a Parr Reactor with about 2% of Nickel hydrogenation catalyst (containing 25% Nickel) or about 0.5% of Palladium on carbon (containing 10% Pd) or about 0.5% of Platinum on alumina. The reactor was charged with hydrogen at 300 Psi and at 150° C. for about 12 hours. The reaction was monitored by NMR & GC to check the complete reduction of both olefinic chain as well as phenolic ring. On completion of the reaction, the catalyst was filtered out and saturated alkyl cyclohexanol derivative was isolated.

EXAMPLE 2

Preparation of Saturated CNSL Phosphorodithioic Acid

Approximately 300 g of alkylcyclohexanol derived by hydrogenation of distilled cashew nut shell liquid was charged to a 1 liter reactor equipped with agitator and condenser. The contents were warmed to 50.degree. C. Subsequently 222 g of phosphorus pentasulfide was slowly added to the reactor under constant stirring, over a period of one hour, while maintaining temperature of 50–70.degree. C. After addition, the temperature was further maintained at 90–100.degree C. for three hours. On completion of reaction, the product was filtered.

EXAMPLE 3

Dibutylamine csalt of CNSL Phosphorodithioic Acid

Approximately 1.0 mole of product of example 2 was treated with 1.0 mole of dibutylamine, for 20–40 minutes at 30–40.degree. C., with continuous stirring, till the exothermic reaction was complete, leading to the formation of dibutylamine salt of saturated CNSL phosphorodithioic acid.

EXAMPLE 4

Diisononylamine Salt of CNSL Phosphorodithioic Acid

Approximately 1.0 mole of product of example 2 was treated with 1.0 mole of diisononylamine, for 20–40 minutes at 30–40.degree. C., with continuous stirring, till the exothermic reaction was complete, leading to the formation of diisononylamine salt of saturated CNSL phosphorodithioic acid.

EXAMPLE 5

Primene-81R Amine Salt of CNSL Phosphorodithioic Acid

Approximately 1.0 mole of product of example 2 was treated with 1.0 mole of a commercial t-alkyl primary amine (C.sub.12), Primene-81R, for 20–40 minutes at 30–40.degree. C., with continuous stirring, till the exothermic reaction was complete, leading to the formation of t-alkyl primary amine (Primene-81R) salt of saturated CNSL phosphorodithioic acid.

EXAMPLE 6

Dipropylamine Salt of Saturated CNSL Phosphorodithioic Acid

Approximately 1.0 mole of product of example 2 was treated with 1.0 mole of dipropylamine for 20–40 minutes at 30–40.degree. C., with continuous stirring, till the exothermic reaction was complete, leading to the formation of dipropylamine salt of saturated CNSL phosphorodithioic acid.

EXAMPLE 7

Primene-JMT Amine Salt of CNSL Phosphorodithioic Acid

Approximately 1.0 mole of product of example 2 was treated with 1.0 mole of commercial t-alkyl primary amine (C.sub.18), Primene-JMT, for 20–40 minutes at 30–40.degree. C., with continuous stirring, till the reaction was complete, leading to the formation of t-alkyl primary amine (Primene-JMT) salt of CNSL phosphorodithioic acid.

EXAMPLE 8

Bis(2-ethylhexyl)Amine Salt of Saturated CNSL Phosphorodithioic Acid

Approximately 1.0 mole of product of example 2 was treated with 1.0 mole of bis(2-ethylhexyl)amine for 20–40 minutes at 30–40.degree. C., with continuous stirring, till the exothermic reaction was complete, leading to the formation of bis(2-ethylhexyl)amine salt of saturated CNSL phosphorodithioic acid.

EXAMPLE 9

2-Ethylhexylamine & Bis(2-Ethylhexyl)Amine Salt of Saturated CNSL Phosphorodithioic Acid Approximately 1.0 mole of product of example 2 was treated with a mixture of 0.5 mole of 2-ethylhexylamine and 0.5 mole of bis(2-ethylhexyl)amine, for 20–40 minutes at 30–40.degree. C., with continuous stirring, till the exothermic reaction was complete, leading to the formation of 2-ethylhexylamine & bis(2-ethylhexyl)amine salt of saturated CNSL phosphorodithioic acid.

Performance Evaluation of Products

The synthesised allylcyclohexylaminophosphorodithioates were evaluated in a solvent refined, highly paraffinic, 150 neutral grade, mineral base oil having a kinematic viscosity of 28.8 at 40 °C. and 5.0 cSt at 100° C.

A four ball machine was used for studying antiwear properties, involving measurement of wear scar on the ball at 392N load, 55° C. temperature and 1800 rpm for one hour. In general, alkylcyclohexylaminophosphorodithioates reduced wear scar dia over unformulated base oil, by 50–75% at 0.5% dosage (Table-1).

Extreme pressure properties were determined by measuring the weld load, in duplicate, on a four ball machine according to ASTM D-2783 test method, while increasing the load in stages of 981N, 1099N, 1236N, 1570N, 1766N, 1962N and 2206N. Synthesised alkylcyclohexylaminophosphorodithioates showed an increase in weld load from 40–80% at additive dosage of 0.5–2.0% (Table-1).

Antioxidant performance of the blends was determined by differential scanning calorimetry (DSC), adopting temperature range of 100–350° C., heating rate of 10° C. per minute and oxygen flow rate of 60–80 ml/minute. The temperature at the onset of oxidation was taken as the criterion for assessment of antioxidant performance. In general, claimed alkylarylaminophosphorodithioates increased the temperature of the onset of oxidation by 30–85° C., w.r.t. unformulated base oil (Table-1).

Antifriction properties were measured by an oscillating friction and wear test apparatus, under the point contact conditions. The minimum stabilised value of the coefficient of the friction, recorded during the continuous run, was taken as a criterion for friction. Synthesised alkycyclohexylaminophosphorodithioates, at 0.5–1.0% level reduced coefficient of friction by 35–55%, as compared to base oil (Table-1).

The above data clearly demonstrates that additive amounts of the di(alkylcyclohexyl) aminophosphorodithioates, derived from saturated CNSL, in premium quality automotive and industrial lubricants significantly enhance the lubricants energy efficiency, antiwear, antioxidant and extreme pressure properties. The unique additives described in this patent application are usefull at low concentrations, are non-metallic and do not contain any potentially corrosive sulfur. These salts can be readily prepared in a one pot process. Furthermore, development and use of these multifunctional lubricant/fuel additives, derived from CNSL, a renewable and biodegradable product from vegetable sources and often available at very low price, would amount to substantial overall reduction in the cost of quality, energy efficient lubricant/fuel formulations.

TABLE 1

PERFORMANCE EVALUATION OF CNSL DERIVED MULTIFUNCTIONAL ADDITIVES

| EXAMPLE No. | ADDITIVE CONC. (% w/w) | COEFF. OF FRICTION (.mu.) | WEAR SCAR DIA (mm) | WELD LOAD (Kq) | ON-SET OF OXIDATION TEMPERATURE (.degree. C.) |
|---|---|---|---|---|---|
| 3 | 0.5 | 0.10 | 0.65 | 200 | 256.1 |
| 3 | 1.0 | 0.095 | 0.50 | 200 | 278.9 |

TABLE 1-continued

PERFORMANCE EVALUATION OF CNSL DERIVED MULTIFUNCTIONAL ADDITIVES

| EXAMPLE No. | ADDITIVE CONC. (% w/w) | COEFF. OF FRICTION (.mu.) | WEAR SCAR DIA (mm) | WELD LOAD (Kq) | ON-SET OF OXIDATION TEMPERATURE (.degree. C.) |
|---|---|---|---|---|---|
| 4 | 0.5 | 0.105 | 0.60 | 180 | 282.3 |
| 4 | 1.0 | 0.085 | 0.70 | 180 | 274.9 |
| 5 | 0.5 | 0.09 | 0.55 | 180 | 265.8 |
| 5 | 1.0 | 0.08 | 0.50 | 200 | 278.6 |
| 6 | 0.5 | 0.095 | 1.85 | 180 | 214.8 |
| 6 | 1.0 | 0.085 | 0.90 | 180 | 220.5 |
| 7 | 0.5 | 0.10 | 0.55 | 200 | 228.7 |
| 7 | 1.0 | 0.09 | 0.50 | 225 | 278.0 |
| 8 | 0.5 | 0.09 | 0.50 | 180 | 233.4 |
| 8 | 1.0 | 0.085 | 0.65 | 200 | 238.2 |
| BASE OIL | — | 0.17 | 1.90 | 112 | 192.2 |

We claim:

1. A process for the preparation of a multi-functional additive, amino di(alkylcyclohexyl) phosphorodithioate, for use as an additive in a lubricant composition comprising the steps of:

(a) hydrogenating distilled technical cashew nut shell liquid (CNSL) with a catalyst to fully hydrogenate the olefinic chain and aromatic ring of the precursor and obtain fully saturated CNSL (b) reacting at a temperature of from 20 to 140° C. said fully saturated cashew nut shell liquid with phosphorus pentasulfide to obtain corresponding unpolymerized cashew nut shell liquid phosphorodithioic acid; and (c) condensing the unpolymerized cashew nut shell liquid phosphorodithioic acid with at least one amine to obtain the amino di(alkylcyclohexyl) phosphorodithioate.

2. The process as claimed in claim 1 wherein said catalyst is palladium, platinum or nickel.

3. The process as claimed in claim 1, wherein at least one amine is selected from the group consisting of primary, secondary and tertiary alkyl/alkylaryl amines having an alkyl chain ranging from $C_1$ to $C_{20}$.

4. The process as claimed in claim 1, wherein the at least one amine is a mixture of amines selected from the group consisting of primary, secondary and tertiary alkyl and alkylaryl amines.

5. The process as claimed in claim 4 wherein said secondary amines are selected from the group consisting of dipentylamine, dihexylamine, dicyclohexylamine, bis(2-ethylhexyl)amine, dioctylamine, dinonylamine, and didodecylamine.

6. The process as claimed in claim 4 wherein said primary amines are selected from the group consisting of oleyl amine, stearyl amine, isostearyl amine, cocoamine, tallow amine, hydrogenated tallow amine, t-alkylamines, diethanolamine, dodecylamine, decylamine, octylamine, 2-ethylhexylamine and butylamine.

7. The process as claimed in claim 4 wherein said tertiary amines are selected from the group consisting of triethylamine, tributylamine, and triethanol amine.

8. The process as claimed in claim 4 wherein said at least one amine is a mixture of amines selected from the group consisting of diethylenetriamine, triethylenetetramine, N-coco-1,3-propylenediamine, and N-oleyl-1,3-propylene diamine.

9. The process as claimed in claim 1, wherein the reacting and the condensing are carried out in the presence of a solvent.

10. The process as claimed in claim 1, wherein the at least one amine and the phosphorodithioic acid are present in stoichiometric ratios of acid to amine ranging from about 3:1 to about 1:3.

11. The process as claimed in claim 10, wherein the at least one amine and the phosphorodithioic acid are present in stoichiometric ratios of acid to amine ranging from 2:1 to 1:2.

12. A lubricant composition comprising:

a major proportion of a material selected from the group consisting of an oil of lubricating viscosity and a grease and an additive comprising amino di(alkylcyclohexyl) phosphorodithioate which is a condensation product of unpolymerized cashew nut shell liquid phosphorodithioic acid with at least one amine.

13. The lubricant composition as claimed in claim 12, wherein the additive is present in an amount ranging from about 0.1 to about 10 wt %, preferably 0.5–5 wt %.

14. The lubricant composition as claimed in claim 12, wherein the oil of lubricating viscosity is selected from the group consisting of a mineral oil, a synthetic oil, and mixtures thereof.

15. The lubricant composition as claimed in claim 14 wherein said synthetic oil is selected from the group consisting of polypropylene glycol, trimethylol propane esters, neopentyl and pentaerythritol esters, polyethylene glycol, di(2-ethylhexyl) adipate, fluorocarbons, siloxanes, phenoxy phenyl ethers and poly alphaolefins.

16. The lubricant composition as claimed in claim 12 further comprising an additive selected from the group consisting of polyalkyl succinimide, polyalkenyl ester dispersants, metallic sulfonates, metallic phenates, metallic phosphorodithioates, and polymeric viscosity index improvers.

17. The lubricant as claimed in claim 12, wherein the material is a grease selected from the group consisting of a lithium grease, a calcium grease, a sodium grease, a clay, and a titanium grease.

18. The lubricant composition as claimed in claim 12, wherein the additive is present in an amount of from 0.5 to 5 wt %.

19. A lubricant composition comprising a major proportion of a material selected from the group consisting of an oil of lubricating viscosity and a grease and an amino di(alkylcyclohexyl) phosphorodithioate additive prepared by (a) hydrogenating distilled technical cashew nut shell liquid with a catalyst to fully hydrogenate the olefinic chain and aromatic ring of the precursor and obtain fully saturated cashew nut shell liquid, (b) reacting at a temperature of from 20 to 140° C. said fully saturated cashew nut shell liquid with phosphorus pentasulfide to obtain corresponding unpolymerized cashew nut shell liquid phosphorodithioic acid, and (c) condensing the unpolymerized cashew nut shell liquid phosphorodithioic acid with at least one amine to obtain amino di(alkylycyclohexyl) phosphorodithioate.

* * * * *